US009039122B2

(12) United States Patent
Walker et al.

(10) Patent No.: US 9,039,122 B2
(45) Date of Patent: May 26, 2015

(54) CONTROLLED COOLING OF PRINT MEDIA FOR A PRINTING SYSTEM

(71) Applicants: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(72) Inventors: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(73) Assignee: Ricoh Company, Ltd., Tokyo (JP)

( * ) Notice: Subject to any disclaimer, the term of this patent is extended or adjusted under 35 U.S.C. 154(b) by 16 days.

(21) Appl. No.: 13/760,487

(22) Filed: Feb. 6, 2013

(65) Prior Publication Data

US 2014/0218432 A1 Aug. 7, 2014

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 29/377*** | (2006.01) |

(52) U.S. Cl.

CPC ..... *B41J 29/377* (2013.01); *B41J 11/002* (2013.01)

(58) Field of Classification Search

USPC ..... 347/102, 16, 17

See application file for complete search history.

(56) References Cited

U.S. PATENT DOCUMENTS

| | | | | |
|---|---|---|---|---|
| 5,043,741 | A | 8/1991 | Spehrley, Jr. | |
| 5,168,289 | A | 12/1992 | Katakabe et al. | |
| 5,281,442 | A | 1/1994 | Fulton | |
| 6,606,948 | B1 | 8/2003 | Austin et al. | |
| 6,876,823 | B2 | 4/2005 | Kojima et al. | |
| 7,167,193 | B2 | 1/2007 | Goetzke et al. | |
| 7,966,743 | B2 | 6/2011 | Piatt et al. | |
| 2006/0071996 | A1 | 4/2006 | Kruijt | |
| 2009/0225149 | A1 | 9/2009 | Osawa et al. | |
| 2010/0045720 | A1* | 2/2010 | Williams et al. | 347/14 |
| 2011/0069104 | A1 | 3/2011 | Tsuzawa | |
| 2011/0102525 | A1* | 5/2011 | Larson et al. | 347/102 |
| 2011/0148973 | A1 | 6/2011 | Chappell et al. | |
| 2011/0205321 | A1 | 8/2011 | Kobayashi et al. | |
| 2012/0050372 | A1 | 3/2012 | Yamaguchi | |
| 2012/0062638 | A1 | 3/2012 | Toya | |

FOREIGN PATENT DOCUMENTS

| | | | |
|---|---|---|---|
| DE | 202010002859 | | 5/2010 |
| DE | 102012208840 | A1 | 12/2012 |

* cited by examiner

*Primary Examiner* — Stephen Meier
*Assistant Examiner* — Renee I Wilson
(74) *Attorney, Agent, or Firm* — Duft Bornsen & Fettig LLP

(57) ABSTRACT

Systems and methods control the rate of cooling of a print media downstream of a drying process. One embodiment comprises a printing system. The printing system includes a print engine that applies colorant onto a continuous-form media. The printing system further includes a radiant dryer downstream of the print engine along a media path, and includes a drum downstream of the radiant dryer along the media path. The drum includes a heat source. The printing system estimates a temperature of the media, estimates a temperature of the drum, and adjusts heat applied to the drum utilizing the heat source to maintain the temperature of the drum below the temperature of the media within a threshold amount.

20 Claims, 3 Drawing Sheets

CONTROLLED COOLING OF PRINT MEDIA FOR A PRINTING SYSTEM

FIELD OF THE INVENTION

The invention relates to the field of printing systems.

BACKGROUND

Businesses or other entities having a need for volume printing typically purchase a production printer. A production printer is a high-speed printer used for volume printing, such as 100 pages per minute or more. The production printers are typically continuous-form printers that print on paper or some other printable medium that is stored on large rolls.

A production printer typically includes a localized print controller that controls the overall operation of the printing system, a print engine (sometimes referred to as an "imaging engine" or as a "marking engine"), and a dryer. The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge colorants as controlled by the printhead controller. The printhead array is formed from multiple printheads that are spaced in series along a particular width so that printing may occur across the width of the medium. The dryer is used to heat the medium to dry the colorant.

In dryers that apply a great deal of heat over a short period of time, it remains a problem to ensure that the medium is properly dried. Too much heat can cause the medium to char or burn. At the same time, too little heat can result in the colorant on the medium remaining wet, resulting in smearing or offsetting that reduces the print quality of jobs. Further, large variations in temperatures across the medium can arise during the heating process due to the varying densities of colorant applied to the medium and variations in the energy absorption characteristics of the colorants. This may cause problems with the medium such as curling or wrinkling due to non-uniform stresses across the medium during this high rate of thermal change. These problems are typically amplified as the paper cools in an uncontrolled and non-uniform manner.

SUMMARY

Embodiments described herein control the rate of cooling of a print media after the drying process. Downstream of a radiant dryer, a media contacts a drum that includes a heat source. Power applied to the heat source is adjusted to maintain the temperature of the drum below the temperature of the media within a threshold amount. When the drum temperature is maintained below the temperature of the media within the threshold amount, a controlled cooling of the media occurs. The controlled cooling allows the temperature of the media to reach a more uniform temperature during the cooling process, which eliminates curling or wrinkling of the media and enables dimensional stability and improved control of the web.

One embodiment is a control system implemented in a printing system. The printing system includes a print engine that is operable to apply a colorant onto a continuous-form medium, and further includes a radiant dryer disposed downstream of the print engine along a media path. The apparatus further includes a drum disposed downstream of the radiant dryer along the media path, and an energy source within the drum that is operable to heat the drum based on a heating power. The control system is operable estimate a temperature of the medium, to estimate a temperature of the drum, and to adjust the heating power to maintain the temperature of the drum below the temperature of the medium within a threshold amount.

Another embodiment is a method operable in a printing system for controlling the rate of cooling of a print media, where the printing system includes a print engine that is operable to apply colorant onto a continuous-form medium, and a radiant dryer disposed downstream of the print engine along a media path. The method comprises estimating a temperature of the medium, and estimating a temperature of a drum disposed downstream of the radiant dryer along the media path. The drum in includes an energy source that is operable to heat the drum based on a heating power. The method further comprises adjusting the heating power to maintain the temperature of the drum below the temperature of the medium within a threshold amount.

Another embodiment is a non-transitory computer readable medium embodying programmed instructions executable by a processor of a printing system, where the printing system includes a print engine that is operable to apply colorant onto a continuous-form medium, and a radiant dryer disposed downstream of the print engine along a media path. The instructions direct the processor to estimate a temperature of the medium, and to estimate a temperature of a drum, where the drum is disposed downstream of the radiant dryer along the media path and includes an energy source that is operable to heat the drum based on a heating power. The instructions further direct the processor to adjust the heating power to maintain the temperature of the drum below the temperature of the medium within a threshold amount.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
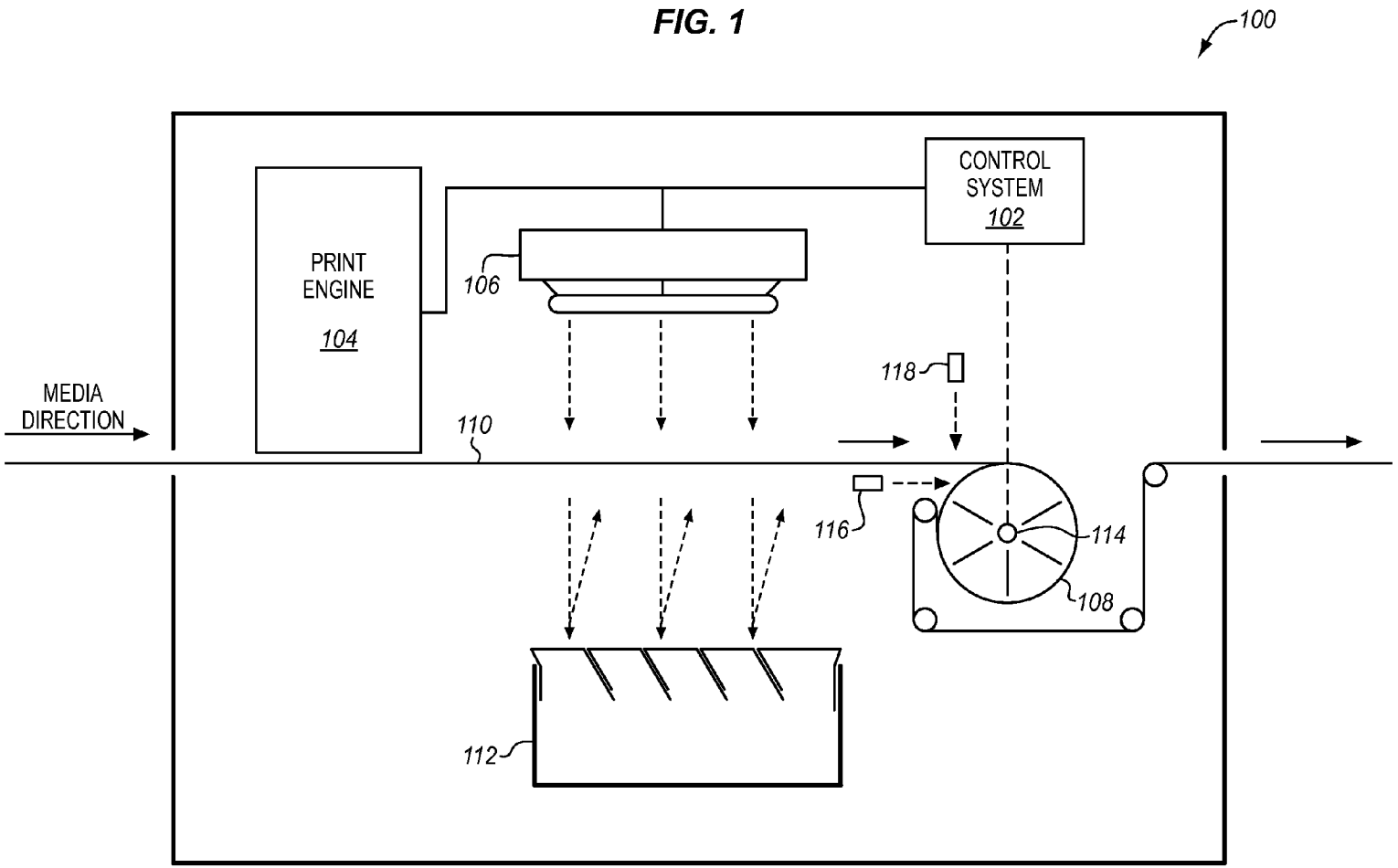
FIG. 1 is a block diagram of a printing system in an exemplary embodiment.

FIG. 1 is a block diagram of a printing system 100 in an exemplary embodiment. In this embodiment, printing system 100 includes a control system 102, a radiant dryer 106, a reflector 112, a drum 108, and a print engine 104. In some embodiments, sensors 116 and 118 may be utilized to measure the temperatures of drum 108 and a media 110, respectively. A web of print media 110 traverses a media path through printing system 100 in the direction indicated by the arrow in FIG. 1. During the printing process, media 110 travels along the media path proximate to print engine 104 for marking with a wet colorant, such as aqueous inks Media 110, now wet with the colorant, continues along the media path and has heat applied to media 110 by dryer 106 in conjunction with reflector 112. After heat is applied to media 110, media 110 continues along the media path and wraps around drum 108, which is utilized to control the rate of cooling of media 110 in printing system 100. Drum 108 may be a solid platen or hollow as a matter of design choice. Further, the shape of a contact surface of drum 108 and media 110 is a matter of design choice.

Drum 108 includes an energy source 114 that applies heat to drum 108 based on a heating power. Some examples of energy source 114 are an Infra-Red source, a resistive heating source, etc. Typically, printing systems include heated drums as part of the drying process. In such systems, the drums are heated to a temperature much hotter than the temperature of media 110 to facilitate drying of the colorants applied to media 110. However, in this embodiment, drum 108 is maintained at a temperature which is less than the temperature of media 110 to control the cooling rate of media 110. Therefore, drum 108 is not simply an extension of radiant dryer 106, which performs the drying process for printing system 100. This will become more readily apparent in the following discussion.

One problem with printing systems is that curling or wrinkling may occur in media 110 if media 110 cools too quickly after traversing radiant dryer 106. Typically, hot spots are present along media 110 during the drying process due to differences in colorant densities and/or energy absorption rates of the colorants. For example, some sections of media 110 may have high colorant coverage, which may absorb more energy from radiant dryer 106 during the drying process and therefore, become much hotter than other sections of media 110. Or, some sections of media 110 may have colorants applied that absorb more energy from radiant dryer 106 during the drying process than other colorants, and therefore, become much hotter than other sections of media 110. If media 110 cools at a high rate downstream to the drying process, the large temperature differences across media 110 may induce stresses and cause curling or wrinkling of media 110. Curling or wrinkling of media 110 is undesirable, as it may result in tearing or dimensional instability in media 110 during the printing process or may result in a poor quality printed output.

In this embodiment, printing system 100 adjusts a heating power applied to energy source 114 to maintain a temperature of drum 108 below the temperature of media 110 by a threshold amount. For example, printing system 100 may maintain the temperature of drum 108 about 10 degrees Celsius below the temperature of media 110. Controlling the temperature differential between media 110 and drum 108 allows a controlled rate of cooling for media 110, which reduces or eliminates curling and wrinkling of media 110 as media 110 cools. Also, because media 110 may be tightly drawn against drum 108 to facilitate a more uniform heat transfer between media 110 and drum 108, the dimensions of media 110 may be more stabilized during the cooling process, thus further reducing the potential for curling or wrinkling of media 110. Also, the increased cooling of high absorbing marked sections of media 110 results in a more uniform output temperature of media 110.

To maintain the temperature of drum 108 below the temperature of media 110 within a threshold amount, control system 102 of printing system 100 may estimate the temperature of media 110 and/or drum 108, may utilizes sensors 118 and 116 to directly measure the temperatures of media 110 and/or drum 108, etc. Broadly speaking, control system 102 in this embodiment comprises any system, component, or device that is operable to control the rate of cooling of media 110 downstream of the drying process.

Consider an example whereby a print operator is tasked with printing a job at printing system 100, which has been enhanced to control the rate of cooling of media 110. The print operator may specifically select printing system 100 based on the combination of colorants and print media specified in a job ticket for the print job, especially in cases where the combination is more prone to promote curling or wrinkling of the specified print media if the rate of cooling is uncontrolled. The print operator initiates printing the job, which causes media 110 to traverse along a media path through printing system 100 in the direction indicated by the arrow in FIG. 1. Print engine 104 marks media 110 with a colorant based on the print data for the job, and radiant dryer 106 applies heat to media 110 to dry the colorant. Downstream of radiant dryer 106, media 110 wraps around drum 108 as part of a cooling phase for media 110.

Figure 2:
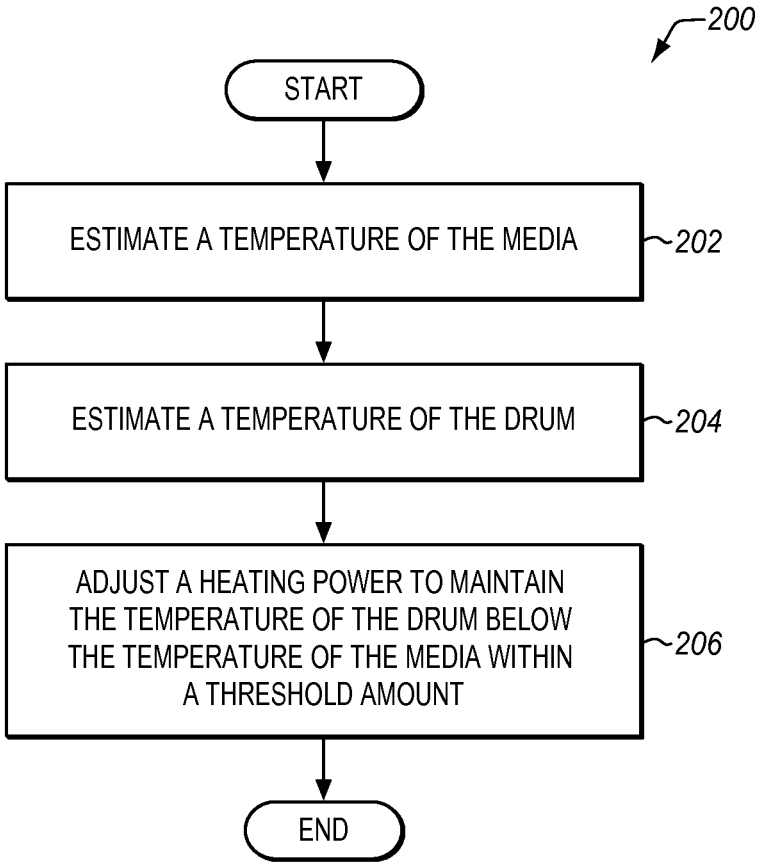
FIG. 2 is a flowchart illustrating a method for controlling the rate of cooling of a print media in an exemplary embodiment.

FIG. 2 illustrates a method 200 of controlling the rate of cooling of a print media in an exemplary embodiment. The steps of method 200 are described with reference to printing system 100 of FIG. 1, but those skilled in the art will appreciate that method 200 may be performed in other systems. The steps of the flowchart described herein are not all inclusive and may include other steps not shown. The steps described herein may also be performed in an alternative order.

In step 202, control system 102 estimates a temperature of media 110. Estimating the temperature of media 110 may be performed in a number of different ways. For instance, control system 102 may analyze the power applied to radiant dryer 106, which affects the temperature of media 110. Another way to estimate the temperature of media 110 is for control system 102 to analyze the amount of colorant applied to media 110 by print engine 104, which affects the area of colorant and/or the density of colorant that absorbs energy from radiant dryer 106. Another way to estimate the temperature of media 110 is for control system 102 to analyze the types of colorants applied to media 110, as different colorants absorb energy from radiant dryer 106 differently. For example, in a CMYK printing system, the colorants used are Cyan, Magenta, Yellow, and Key black. Key black colorants, or other relatively high energy absorbing fluids, may absorb more energy per unit time from radiant dryer 106 than the other CMY colorants. Thus, control system 102 may estimate the temperature of media 110 based on the ratio of Key black to non-Key black colorant coverage as applied to media 110. In some embodiments, control system 102 estimates the bulk temperature of media 110. The bulk temperature of media 110 relates to the actual temperature of the bulk substrate, in contrast to hot spots on the substrate that arise due to local heating. For example, non-marked portions of media 110 may reach about 100 degrees Celsius, while marked portions may be closer to about 200 degrees Celsius. In some embodiments, control system 102 may measure the temperature of media 110 directly utilizing sensor 118, which may be located proximate to where media 110 first contacts drum 108. Sensor 118 may be a temperature sensor, a humidity sensor, or some other type of sensor that allows control system 102 to estimate or calculate the temperature of media 110 based on the data recovered from sensor 118.

In step 204, control system 102 estimates a temperature of drum 108. In a similar manner to estimating a temperature of media 110, control system 102 may estimate the temperature of drum 108 in a number of different ways. Control system 102 may estimate the temperature based on the amount of time that printing system 100 has been printing. For example, when initiating a print job at printing system 100, drum 108 may be close to ambient temperatures if printing system 100 has been idle between printing jobs for a while. Control system 102 may also estimate the temperature of drum 108 based on a heat transfer between media 110 and drum 108. For instance, the type of media 110, the colorants used, the colorant densities applied to media 110, etc., may affect the heat transfer rate between media 110 and drum 108. In some embodiments, control system 102 may measure the temperature of drum 108 directly utilizing sensor 116, which is located proximate to drum 108. Sensor 116 may be a temperature sensor, a humidity sensor, or some other type of sensor that allows control system 102 to estimate or calculate the temperature of drum 108 based on the data recovered from sensor 116.

In step 206, control system 102 adjusts a heating power applied to energy source 114 to maintain the temperature of drum 108 below the temperature of media 110 within a threshold amount. As discussed previously, modifying the heating power applied to energy source 114 changes the amount of heat applied to drum 108 by energy source 114. Control system 102 may, in cases whereby the temperature differential between media 110 and drum 108 is larger than the threshold amount, increase the heating power applied to energy source 114 in order to increase the temperature of drum 108. In contrast, control system 102 may, in cases whereby the temperature of drum 108 is higher than the temperature of media 110, reduce the heating power applied to energy source 114 in order to reduce the temperature of drum 108.

In some cases, control system 102 may reduce the heating power applied to energy source 114 to zero, while the temperature of drum 108 continues to remain below the temperature of media 110 within the threshold amount. This case may arise when the heat transfer between media 110 and drum 108 is sufficient to ensure that the temperature of drum 108 is below, yet still within the threshold amount, of the temperature of media 110.

As discussed, there may be instances whereby printing system 100 is idle between printing jobs, such as the start of the work day. In these instances, the temperature of drum 108 may be quite low, such as close to ambient temperature. Prior to printing a job under these conditions, control system 102 may pre-heat drum 108 to a target temperature. The target temperature may be below a temperature that media 110 is expected to reach downstream of the drying process when the job begins printing. This allows for the controlled cooling of media 110 when a job is initiated. Pre-heating drum 108 thus alleviates the possible problems associated with allowing the beginning of a print job to undergo an un-controlled cooling process that results from a large temperature difference between media 110 and drum 108.

Figure 3:
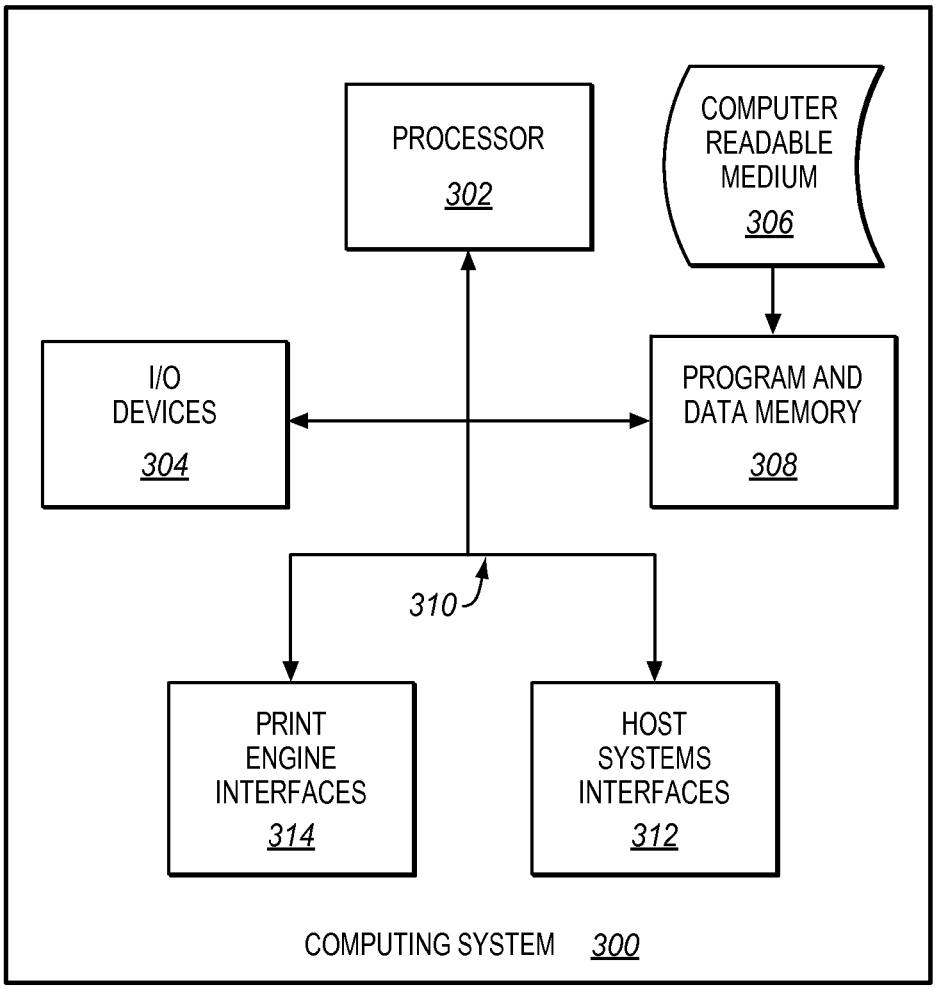
FIG. 3 illustrates a processing system operable to execute a computer readable medium embodying programmed instructions to perform desired functions in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 3 illustrates a computing system 300 in which a computer readable medium may provide instructions for performing the method of FIG. 2 in an exemplary embodiment.

Furthermore, the invention can take the form of a computer program product accessible from a computer-usable or computer-readable medium 306 providing program code for use by or in connection with a computer or any instruction execution system. For the purposes of this description, a computer-usable or computer readable medium 306 can be any apparatus that can contain, store, communicate, or transport the program for use by or in connection with the instruction execution system, apparatus, or device.

The medium 306 can be an electronic, magnetic, optical, electromagnetic, infrared, or semiconductor system (or apparatus or device) or a propagation medium. Examples of a computer-readable medium 306 include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include one or more processors 302 coupled directly or indirectly to memory 308 through a system bus 310. The memory 308 can include local memory employed during actual execution of the program code, bulk storage, and cache memories which provide temporary storage of at least some program code in order to reduce the number of times code is retrieved from bulk storage during execution.

Input/output or I/O devices 304 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 312, or remote printers or storage devices through intervening private or public networks. Modems, cable modem and Ethernet cards are just a few of the currently available types of network adapters. System 300 further includes print engine interfaces 314.

Although specific embodiments were described herein, the scope of the invention is not limited to those specific embodiments. The scope of the invention is defined by the following claims and any equivalents thereof.

We claim:

1. An apparatus comprising:

a control system implemented in a printing system, wherein the printing system includes a print engine that is configured to apply colorant onto a continuous-form medium, and further includes a radiant dryer disposed downstream of the print engine along a media path;

a drum disposed downstream of the radiant dryer along the media path; and an energy source within the drum that is configured to heat the drum based on a heating power;

the control system is configured to estimate a temperature of the medium based on a power applied to the radiant dryer, to estimate a temperature of the drum, and to adjust the heating power based on the estimate to maintain the temperature of the drum below the temperature of the medium within a threshold amount.

2. The apparatus of claim 1 wherein:

the control system is further configured to select a heating power to pre-heat the drum, to initiate a printing process, and to adjust the heating power during the printing process to maintain the temperature of the drum below the temperature of the medium within the threshold amount.

3. The apparatus of claim 1 wherein:

the threshold amount is about twenty degrees Celsius.

4. The apparatus of claim 1 wherein:

the control system is further configured to determine if a heat transfer from the medium to the drum is sufficient to maintain the temperature of the drum below the temperature of the medium within the threshold amount, and to terminate the heating power in response determining that the heat transfer is sufficient.

5. The apparatus of claim 1 wherein:

the control system is further configured to measure a temperature of the medium, to measure a temperature of the drum, and to adjust the heating power based on a difference between the temperature of the medium and the temperature of the drum.

6. A method operable in a printing system, wherein the printing system includes a print engine that is operable to apply colorant onto a continuous-form medium, and a radiant dryer disposed downstream of the print engine along a media path, the method comprising:

estimating a temperature of the medium based on a power applied to the radiant dryer;

estimating a temperature of a drum disposed downstream of the radiant dryer along the media path, wherein the drum includes an energy source that is operable to heat the drum based on a heating power; and adjusting the heating power based on the estimate to maintain the temperature of the drum below the temperature of the medium within a threshold amount.

7. The method of claim 6 wherein:

the method further comprises:

selecting a heating power to pre-heat the drum;

initiating a printing process; and adjusting the heating power during the printing process to maintain the temperature of the drum below the temperature of the medium within the threshold amount.

8. The method of claim 6 wherein:

the threshold amount is about twenty degrees Celsius.

9. The method of claim 6 wherein:

the method further comprises:

determining if a heat transfer from the medium to the drum is sufficient to maintain the temperature of the drum below the temperature of the medium within the threshold amount; and terminating the heating power in response determining that the heat transfer is sufficient.

10. The method of claim 6 wherein:

the method further comprises:

measuring a temperature of the medium;

measuring a temperature of the drum; and adjusting the heating power based on a difference between the temperature of the medium and the temperature of the drum.

11. A non-transitory computer readable medium embodying programmed instructions executable by a processor of a printing system, wherein the printing system includes a print engine that is operable to apply colorant onto a continuous-form medium, and a radiant dryer disposed downstream of the print engine along a media path, the instructions directing the processor to:

estimate a temperature of the medium based on a power applied to the radiant dryer;

estimate a temperature of a drum disposed downstream of the radiant dryer along the media path, wherein the drum includes an energy source that is operable to heat the drum based on a heating power; and adjust the heating power based on the estimate to maintain the temperature of the drum below the temperature of the medium within a threshold amount.

12. The medium of claim 11 wherein:

the instructions further direct the processor to:

select a heating power to pre-heat the drum;

initiate a printing process; and adjust the heating power during the printing process to maintain the temperature of the drum below the temperature of the medium within the threshold amount.

13. The medium of claim 11 wherein:

the threshold amount is about twenty degrees Celsius.

14. The medium of claim 11 wherein:

the instructions further direct the processor to:

determine if a heat transfer from the medium to the drum is sufficient to maintain the temperature of the drum below the temperature of the medium within the threshold amount; and terminate the heating power in response determining that the heat transfer is sufficient.

15. The medium of claim 11 wherein:

the instructions further direct the processor to:

measure a temperature of the medium;

measure a temperature of the drum; and adjust the heating power based on a difference between the temperature of the medium and the temperature of the drum.

16. The apparatus of claim 1 wherein:

the control system is further configured to estimate the temperature of the medium based on an amount of colorant applied to the medium by the print engine.

17. The apparatus of claim 1 wherein:

the control system is further configured to estimate the temperature of the medium based on a type of colorant applied to the medium by the print engine.

18. The apparatus of claim 1 wherein:

the control system is further configured to estimate the temperature of the medium based on a ratio of Key black colorant coverage to non-Key black colorant coverage applied to the medium by the print engine.

19. The apparatus of claim 1 wherein:

the control system is further configured to estimate the temperature of the drum based on an amount of time that the printing system has been printing.

20. The apparatus of claim 1 wherein:

the control system is further configured to estimate the temperature of the drum based on an idle time between printing jobs.

* * * * *